US008397610B2

(12) United States Patent
Koch

(10) Patent No.: US 8,397,610 B2
(45) Date of Patent: Mar. 19, 2013

(54) DEVICE FOR SEPARATING A STRAND OF PLASTIC MATERIAL WITH A SUPPORT WHICH SUPPORTS A NOTCHING DEVICE AND A CUTTING DEVICE

(75) Inventor: Rainer Koch, Senden (DE)

(73) Assignee: Hans Lingl Anlagenbau und Verfahrenstechnik GmbH & Co. KG, Krumbach (DE)

( * ) Notice: Subject to any disclaimer, the term of this patent is extended or adjusted under 35 U.S.C. 154(b) by 556 days.

(21) Appl. No.: 12/594,846

(22) PCT Filed: Apr. 14, 2008

(86) PCT No.: PCT/EP2008/002954

§ 371 (c)(1),
(2), (4) Date: Oct. 6, 2009

(87) PCT Pub. No.: WO2008/125326

PCT Pub. Date: Oct. 23, 2008

(65) Prior Publication Data

US 2010/0064871 A1 Mar. 18, 2010

(30) Foreign Application Priority Data

Apr. 13, 2007 (DE) ..... 10 2007 017 485

(51) Int. Cl.
*B26D 3/14* (2006.01)

(52) U.S. Cl. ..... 83/862; 83/879; 83/307.1

(58) Field of Classification Search ..... 83/56, 284–286, 83/307.1, 307.2, 350–353, 862
See application file for complete search history.

(56) References Cited

U.S. PATENT DOCUMENTS 375,319 A * 12/1887 Fergussen ..... 83/151
(Continued)

FOREIGN PATENT DOCUMENTS

DE 8012592 * 9/1980
DE 2921176 * 11/1980
(Continued)

OTHER PUBLICATIONS

Translation of De'176.*

*Primary Examiner* — Sean Michalski
(74) *Attorney, Agent, or Firm* — Scully, Scott, Murphy & Presser, P.C.

(57) ABSTRACT

Device (1) for separating a strand (3) of plastic material, which can be moved along a conveying passage (2), into longitudinal portions (3*a*), having at least one notching device (5) which on all sides of the passage (2) comprises in each case a notching tool (8*a* to 8*d*) which can be moved by means of a tool drive (18) in a tool guide (17) between an initial notching position and a notching position, wherein the cutting device (4) comprises two cutting wire holders (24) which are disposed in mutually opposite-lying boundary regions of the passage (2) and which can be moved transversely with respect to the passage (2) by means of a cutting drive (26) in a cutting guide (25), and wherein the notching device (5) with its notching tools (8*a* to 8*d*) are disposed its passage (2) the support module (9) which is moveable forwards and backwards [sic]. In order to simplify the devices themselves and also the assembly thereof, the cutting device (4) is disposed with its cutting wire holders (24), its cutting guide (25) and its cutting drive (26) on the support module (9).

20 Claims, 10 Drawing Sheets

U.S. PATENT DOCUMENTS

| | | | | | |
|---|---|---|---|---|---|
| 400,399 | A | * | 3/1889 | Freese | 83/268 |
| 477,915 | A | * | 6/1892 | Snell | 83/101 |
| 496,982 | A | * | 5/1893 | Snell | 83/102 |
| 1,214,668 | A | * | 2/1917 | Frederickson | 83/307.1 |
| 2,263,474 | A | * | 11/1941 | Scheibl | 83/307.2 |
| 2,641,042 | A | * | 6/1953 | Kopp | 83/285 |
| 3,602,963 | A | * | 9/1971 | Lingl | 83/91 |
| 3,838,621 | A | * | 10/1974 | Keck | 83/401 |
| 4,125,047 | A | * | 11/1978 | Martin | 83/581.1 |
| 4,202,228 | A | * | 5/1980 | Goransson | 83/23 |
| 4,326,439 | A | * | 4/1982 | Frost et al. | 83/27 |
| 4,495,132 | A | * | 1/1985 | Johnson | 264/293 |
| 4,608,893 | A | * | 9/1986 | Huhne | 83/171 |
| 4,646,602 | A | * | 3/1987 | Bleick | 83/408 |
| 4,702,138 | A | * | 10/1987 | Hattori et al. | 83/785 |
| 4,915,000 | A | * | 4/1990 | MacFarlane | 83/651.1 |
| 5,054,994 | A | * | 10/1991 | Leeds et al. | 414/793.4 |
| 5,084,282 | A | * | 1/1992 | Stuart et al. | 425/304 |
| 5,216,963 | A | * | 6/1993 | Leeds et al. | 83/425.3 |
| 7,143,678 | B2 | * | 12/2006 | Callow | 83/862 |
| 7,428,860 | B2 | * | 9/2008 | Vagnby | 83/651.1 |

FOREIGN PATENT DOCUMENTS

| | | | |
|---|---|---|---|
| WO | WO 2006/119929 | A2 | 11/2006 |

* cited by examiner

DEVICE FOR SEPARATING A STRAND OF PLASTIC MATERIAL WITH A SUPPORT WHICH SUPPORTS A NOTCHING DEVICE AND A CUTTING DEVICE

BACKGROUND

The invention relates to a device for separating a strand of plastic material, in particular clay, which can be moved along a conveying passage, into longitudinal portions in accordance with the preamble of claim 1 or 2 or 3.

A device of this type is described in DE 10 2005 021 038 A1. In the case of this previously known device, the notching device is disposed on a frame-like support which extends transversely with respect to the passage, wherein several supports having in each case an associated notching device can be disposed one behind the other in the longitudinal direction of the passage and wherein each notching device is allocated a cutting device having a cutting wire which extends transversely with respect to the passage and can be moved from one side of the passage to the opposite side and back.

SUMMARY

The object of the invention is to simplify a device of the type stated in the introduction. This simplification is intended to improve the construction and/or assembly or disassembly of the support.

This object is achieved by the features of claim 1. Advantageous developments of the invention are described in associated subordinate claims.

In the case of the device in accordance with the invention according to claim 1, the cutting device is disposed with its cutting wire holders and its cutting wire guide on the support. As a consequence, the support is a supporting part not only for the notching device but also for the cutting device and the construction is substantially simplified by reason of the arrangement also of the cutting device on the support, because on further parts of the device attachment features for the cutting device are omitted. Moreover, the support having the cutting device can be prefabricated, which also results in a simplification and permits cost-effective manufacture. A further advantage resides in the fact that no particular assembly measures are required for mounting the cutting device on further parts of the device, as the cutting device is mounted on the support, preferably by means of prefabrication. A further advantage resides in the fact that the support can be mounted on the device as a substantially prefabricated unit, e.g. it can be mounted on a slide of the device which can be displaced longitudinally in a reciprocating manner, in particular by means of a transversely directed assembly movement, preferably from above, and it can be disassembled in the opposite disassembly direction.

Furthermore, it is advantageous also to dispose a cutting drive on the support module, so that the cutting device is disposed with at least one cutting element holder and an associated cutting guide and in each case one cutting drive or a common cutting drive on the support module. In the case of this embodiment, the cutting drive can thus also be attached or mounted in prefabricated state on the support module.

The object is also achieved by the features of independent claim 2. In the case of this embodiment in accordance with the invention, the relevant notching strip is pivotably mounted in one end region thereof in a pivot joint with an articulation spindle extending in parallel with the passage. As a consequence, the notching strip is mounted in one end region thereof by the pivot joint not only in a simple construction but also in a stable manner and in such a way as to be insusceptible to malfunction. This advantageous embodiment is also advantageous for the oppositely disposed notching strip, in particular for an upper and/or lower notching strip(s).

A further advantage of this embodiment in accordance with the invention resides in the fact that the pivot drive for the pivotable notching strip can be disposed not only in a convenient manner not only on one side, e.g. outwardly offset, but also a common pivot drive or expansion and contraction drive can be used for two mutually oppositely disposed pivotable notching strips. The pivot joint which is outwardly offset in relation to the passage can be offset in the longitudinal direction of the notching strip or of a pivot lever or pivot arm supporting it.

During notching, i.e. during penetration of the notching strips into the e.g. ceramic material of the strand, the notching strips exert a pressure onto the strand which can then lead in particular to a displacement of the strand, if the strand is notched laterally. Although during laterally simultaneous notching the lateral compressive stresses can be cancelled out, this is only achieved if the consistency or strength of the strand material is the same. As a consequence, in practice circumstances arise in which there is a risk that different notching stresses will cause the strand to be displaced transversely, which naturally is undesirable and impairs the further treatment of the strand.

Therefore, it is also the object of the invention to form a device in accordance with the preamble of claim 3 in such a manner that it is able to exert a stabilising effect upon the strand.

This object is achieved by the features of independent claim 3. Advantageous developments of the invention are described in associated subordinate claims.

In the case of the embodiment in accordance with the invention as claimed in claim 3, the device comprises on both sides of the passage in each case a support strip having a support surface which extends in parallel with the longitudinal axis of the passage, wherein the spacing between the support strips corresponds to the transverse dimension of the strand and the support surfaces of the support strips lie against the strand and thus support same. As a consequence, the strand receives lateral support, whereby the risk of lateral displacement is prevented or at least substantially reduced.

In order to be able to adapt the support strips to suit different widths of the strand, it is advantageous to dispose and form the support strips so as to be laterally adjustable. This type of embodiment also renders it possible to adjust the support strips for constant strand widths to be initially wider than required and subsequently to move them during functional operation to such an extent inwards that the support surfaces are able to lie against the strand or perform a guiding function.

A particular drive for the support strips can be omitted, if the support strips are attached to the notching strips associated with their sides and therefore can be moved by the drives of the notching strips. In so doing, the support strips can be attached on the inner side to the notching strips and/or can protrude rearwardly therefrom. It is essential that the notching webs of the notching strips protrude beyond the support surfaces of the support strips or notching strips by the depth of the notches, so that in the notching end position the support surfaces lie against the strand.

The invention also includes embodiments which are independent of claims 1 and 2 and 3 and which relate to a cutting device in accordance with claim 6 and a receiving device in accordance with claim 25 for one or several support modules.

The embodiments in accordance with the invention are suitable in a particularly advantageous manner for notching strips which are each formed by means of two chamfering strips which have a spacing from each other extending along the passage, wherein the cutting wire of the cutting device can be moved between the chamfering strips transverse to the passage. By virtue of the invention, the chamfering strips are not only stabilised both by the pivot arms themselves and also by the mounting, they can also each be disposed on their own pivot arm, wherein the associated pivot arms have a spacing from each other which is directed along the passage. This spacing benefits the length of the strand-longitudinal portions which are to be cut, i.e. in the case of this embodiment chamfering strips required for a strand longitudinal portion can be disposed on both sides of the relevant module support, which chamfering strips preferably form a movement unit which can be moved in a convenient manner by means of a drive.

BRIEF DESCRIPTION OF THE DRAWINGS

Advantageous and expedient embodiments of the invention will be explained in detail hereinunder with reference to drawings and exemplified embodiments illustrated in a simplified manner. In the drawings.

DETAILED DESCRIPTION OF EXEMPLARY EMBODIMENTS

Figure 1:
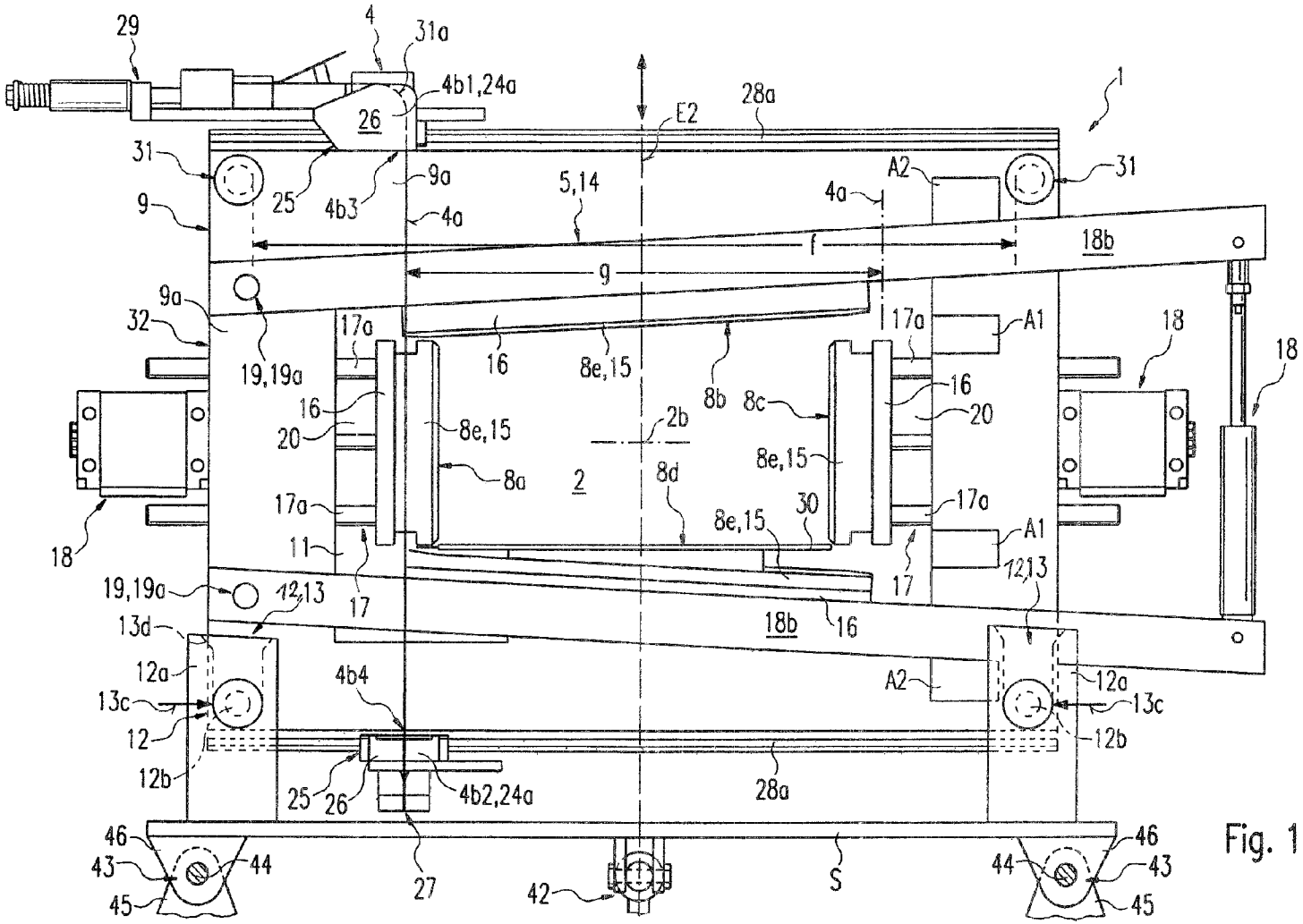
FIG. 1 shows a rear view of a device in accordance with the invention having one or several support modules disposed one behind the other for separating a strand of plastic material, in particular clay, which can be moved along a conveying passage, into longitudinal portions.

The device which is designated in its entirety by the reference numeral 1 consists of several component units, such as e.g. a frame (not illustrated) which stands on the ground and in which a free passage 2, which extends in the longitudinal direction thereof, for the strand 3 (FIG. 6) is disposed. In order to separate the strand 3 into strand-longitudinal portions 3*a*, at least one cutting device 4 is provided with a cutting wire 4*a* which extends transversely with respect to the passage 2, wherein prior to cutting, the strand 3 is provided on all sides with notches 5*a* which are disposed preferably in a common transverse plane and extend transversely and in which the plastic material of the strand 3 is cut transversely. By reason of the cutting in the notches 5*a*, a cutting degree which projects beyond the outer surfaces of the strand portions 3*a* is obviated in each case.

In order to convey the strand 3 through the device 1 in the passage 2, a conveying device 1*a* (FIG. 6) is used which moves the strand 3 forwards preferably in a continuous manner and which can be formed with several conveying device portions, which are disposed one behind the other in the passage direction 2*a*, e.g. a respective conveyor belt. The strand 3 can pass from an extrusion press onto or into the conveying device 1*a*.

The notching and cutting procedures are performed preferably during the movement of the strand 3 through the passage. This is accomplished by means of a slide S which is known per se and has one or several support modules 9, which are disposed one behind the other and have a notching device 5 and a cutting device 4, and which slide is displaceable in a reciprocating manner in the passage direction 2*a* and during notching and cutting is moved forwards at the advancing rate of the strand 3 and is then moved back to its initial position, from which a next notching and cutting procedure is performed. During the forward movement of the support module 9 with the notching device 5 and the cutting device 4, the cutting wire 4*a* can be moved for the purpose of cutting always from one side of the passage to the other side and can then be moved back after expansion of the separated longitudinal portion 3*a* during an idle stroke, which is defined as unilateral or unidirectional cutting (known per se). However, alternating or bidirectional cutting is also possible, in which during a forward movement the cutting wire 4*a* is moved from one side to the other side and after a backward movement and during the next forward movement is then moved back to one side without the above-described expansion (also known per se).

In principle, the device 1 is functional with only one cutting device 4 and only one notching device 5 which is/are disposed and supported on a single support module 9 which extends transversely with respect to the passage 2 from one side thereof to the other side and is formed preferably in the manner of a frame. The support module 9 can be formed in the manner of a plate and can be disposed edgewise and can comprise a through-hole 11 which corresponds approximately to the cross-sectional size of the passage 2.

In order to attach the support module 9 to the slide, a connection device 12, illustrated in a simplified manner, is used with which the support module 9 can be assembled preferably by means of a transversely directed assembly movement, e.g. from the top or from one of the two horizontal sides, and can then be dismantled for the purpose of disassembly, wherein the support module 9 with the notching device 5 and the cutting device 4 forms a module structural unit 32 which can be preassembled and which can be assembled and disassembled optionally in the device 1.

In the Figures of the drawing, the connection device 12 is formed by means of a quick-action connection, e.g. a plug connection 13 having a plug socket or plug opening 13*a* which is open on one side (not illustrated) or at the top (illustrated in the drawing) and into which the support module 9 is inserted from the relevant side with a matching plug pin 13*b* and is secured by means of a releasable locking element 13*c*, e.g. by means of a locking screw or locking pin which comprises an attachment part of the frame or encloses one therein and e.g. encloses it in an insertion hole in the support module 9. The connection device 12 is described in more detail hereinafter.

Figure 4:
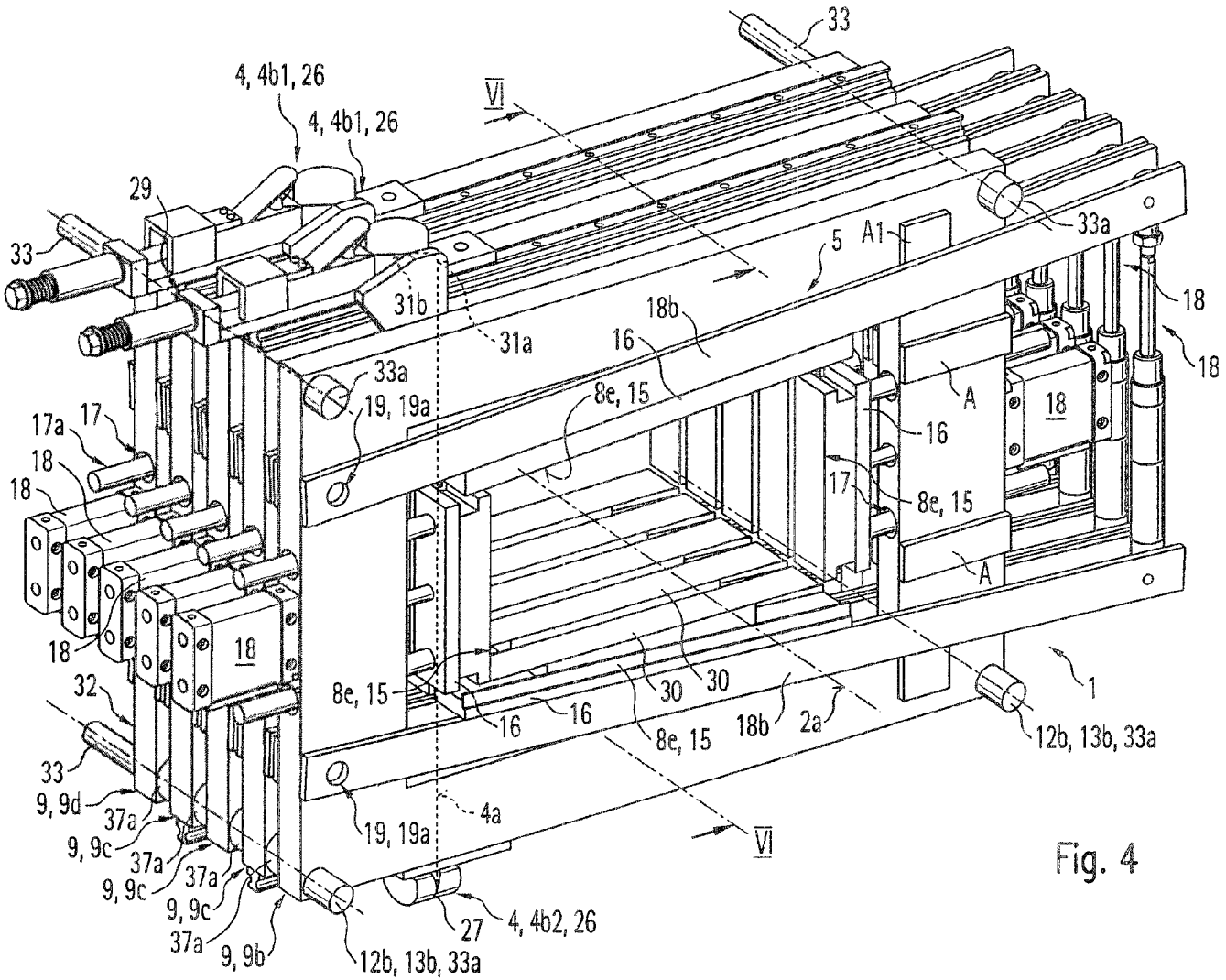
FIG. 4 shows a perspective illustration of several support modules which are disposed one behind the other in the longitudinal direction of the conveying passage and have notching devices and cutting devices for transversely directed notching and cutting of the strand.

In order to enhance performance and rationalise production of the longitudinal portions 3*a*, it is advantageous to dispose several such support modules 9 one behind the other in the passage direction 2*a* as shown in FIG. 4 and subsequent Figures, so that the strand 3 can be notched and cut jointly in several cutting planes E1 which are disposed one behind the other. Preferably, the movement control of the notching device 5 and of the cutting device 4 is formed in such a manner that all four notching tools 8*a* to 8*d* and all cutting wires 4*a* are moved simultaneously. Since the support modules 9 are formed in an identical manner, only one support module 9 needs to be described.

The support module(s) 9 is/are positioned along the assembly direction in a releasable manner on the slide S, e.g. by means of the locking element 13*c*.

As shown in particular in FIG. 1, the support module 9 is formed by means of a plate-like frame 9*a*, whose respective two horizontal and vertical frame portions define the quadrangular through-hole 11. The passage 2 is located in the through-hole 11, wherein the latter has a larger cross-sectional measurement than the passage 2, so that two mutually opposite-lying lateral notching tools 8*a*, 8*c*, an upper notching tool 8*b* and a lower notching tool 8*d*, have space between the inner edge of the frame portions and the passage 2. The notching tools can be moved between an initial notching position which opens the free passage 2 for the strand 3 and a notching position, which is enclosed in the strand 3 by the notch depth, transverse to the central axis 2*b* of the passage 2.

In the case of the present exemplified embodiment, all four notching tools are formed by means of notching strips 8*e*, whose lengths extending transversely with respect to the passage 2 are adapted to the transverse dimensions of the strand 3 such that in their notching positions they press a circumferential notch 5*a* into the strand. Of the four existing notching strips 8*e*, two mutually opposite-lying notching strips 8*e*, in this case the upper and lower notching strip 8*e*, are formed to be such a length that their end regions overlap the two other notching strips 8*e* at least in their notching position.

Within the scope of the invention, the notching strips can comprise the cross-sectional shape of a wedge which is disposed symmetrically in relation to the vertical and whose wedge angle amounts to e.g. about 90° (not illustrated). In the case of this type of notching device 8 which is known per se, the notching strips which are located e.g. in a common transverse plane E1 are disposed in an offset manner in relation to the cutting plane E1 and the cutting device 4 in the passage direction by the length of a strand portion 3*a*.

Figure 2:
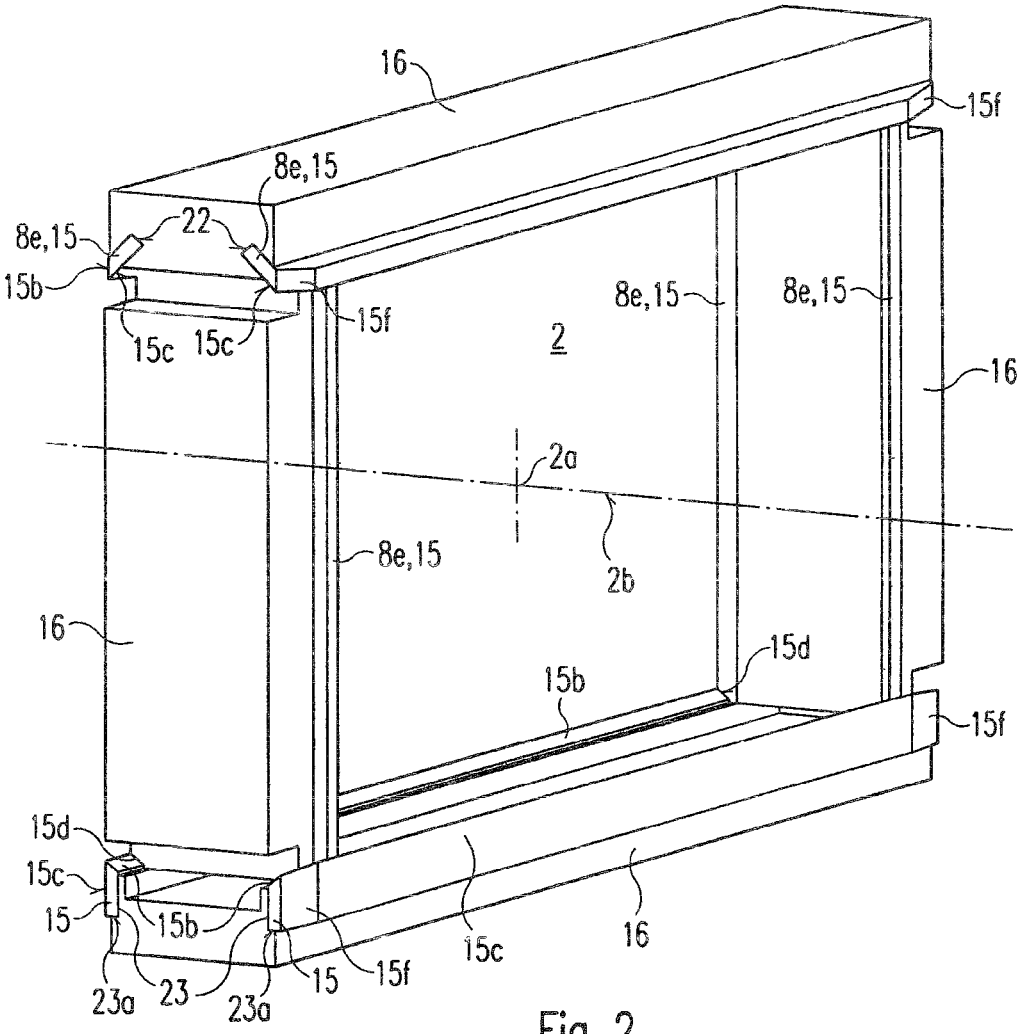
FIG. 2 shows a perspective illustration of four chamfering strips which cooperate in each case in terms of a notching device and which are disposed in the manner of a frame.

In the case of the present exemplified embodiment, the notching device 5 and the associated cutting device 4 are located—as shown in FIG. 2 and subsequent Figures—in a common vertical transverse or cutting plane E1, wherein the notching device 5 is formed by means of a chamfering device 14 which is known per se which at the edges of the front ends of the longitudinal portions 3*a* or blanks still to be cut presses chamfers 14*a* into the strand 3, wherein in each case two chamfers 14*a* which are adjacent one another at the cutting plane E1 each form a common notch 5*a*. In the case of this embodiment, two notching strips 8*e*, namely so-called chamfering strips 15, which are divided in their longitudinal direction are disposed in parallel with one another on all four sides of the conveying passage 2 and—as seen transversely with respect to the passage 2—correspond to the embodiment of undivided notching strips 4*e*. However, the chamfering strips 15 have a mutual spacing a extending along the passage 2 and thus have a slot 15*a* therebetween which under consideration of a movement clearance corresponds to the cross-sectional dimension of the preferably round cutting wire 4*a*. In the case of this embodiment, the notching and cutting procedures can be performed simultaneously, wherein the chamfering strips 15 not only afford the cutting wire 4*a* a guide but also obviate bell mouths of the strand material or cutting burrs.

The chamfering surfaces 15*c* on the chamfering strips 15 corresponding to the desired cross-sectional shape of the chamfers 14*a* are preferably also wedge surfaces which together with the transversely extending cutting plane E1 form an acute angle W1 of in particular about 45°, so that the common notching angle amounts to about 90°.

As seen transversely with respect to the passage direction 2*a*, the region of the cutting plane E1 is provided with two laterally reversed chamfering strips 15, wherein their chamfering surfaces 15*c* are turned away from each other and their mutually facing lateral surfaces 15*b* extend in parallel with or at a free angle to the associated cutting plane E1. These two chamfering strips 15 form a notching movement unit and, particularly as upper chamfering strips 15, they can be connected to each other by means of an e.g. plate-like base part 16 and can be supported thereon.

The notching tool 8*a* to 8*d* thus formed can be moved by means of a notching drive 18 in a transverse guide 17 in a reciprocating manner transversely between the initial notching position and the notching position. The transverse guide 17 can be formed by means of one or two guide rods 17*a* which are spaced apart from one another and which are displaceably mounted in corresponding guide holes in the associated support module 9.

The notching drive 18 can be formed e.g. by means of a cylinder piston drive, whose cylinder is supported on the support module 9 and whose piston rod acts upon the base part 16.

In the case of the present exemplified embodiment, two mutually opposite-lying notching tools, preferably the upper and lower notching tools 8*b*, 8*d*, are each disposed on an associated pivot arm 18*b*, in particular are disposed so as to protrude with respect to each other therefrom, wherein the pivot arms 18*b* are pivotably mounted in their end regions on a side of the passage 2 in pivot joints 19 with horizontal joint pins 19*a* in the associated transverse plane. In the case of this embodiment, the notching drive 18 can be a notching drive 18 which e.g. is common to both pivot arms 18*b*, e.g. also a cylinder piston drive 18*a* which is disposed between the end regions of the pivot arms 18*b* on the other side, in particular externally adjacent the associated support module 9, and is connected preferably in a pivotal manner to the pivot arms 18*b*. The pivot arms 18*b* protrude beyond the notching strips 8*e* at both ends, namely on the bearing side beyond the passage 2 into the region of the frame-like support module 9, into whose region the pivot joint 19 is disposed, and protrude at the other end beyond the support module 9.

For the notching tools 8*b*, 8*d* or notching strips 8*e* which are supported on the pivot arms 18*b*, the guide 17 is formed by the pivot joints 19 and/or the abutment of the pivot arms 18*b* against the rear side or front side of the support module(s) 9.

The respective two mutually associated pivot arms 18*b* are disposed on the front and rear side of the support module 9. In structural terms, this embodiment accommodates the longitudinally directed external spacing between the chamfering strips 15 which are each disposed on the base part 16.

Figure 6:
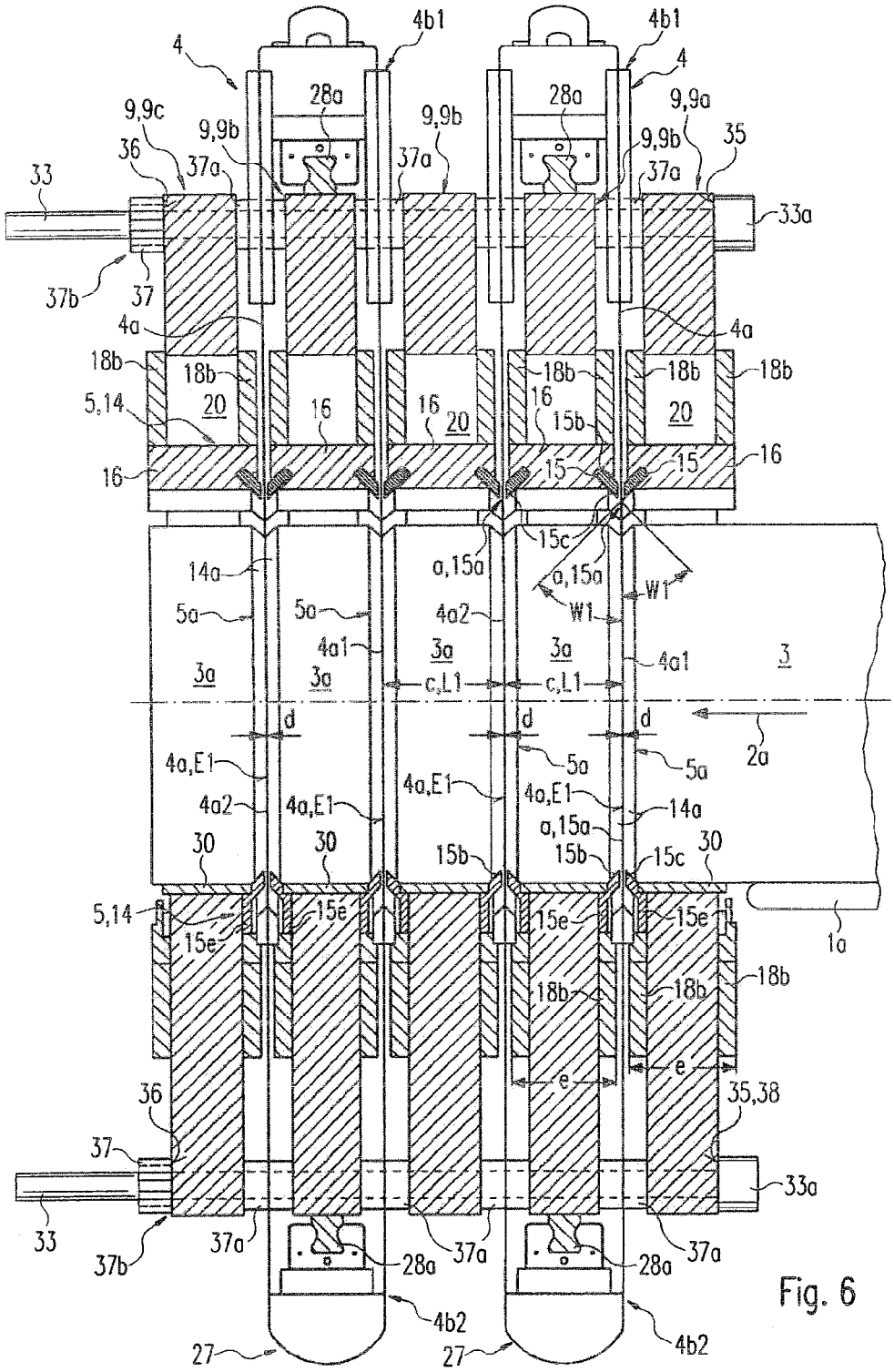
FIG. 6 shows the vertical sectional view VI-VI in FIG. 4.

As shown in particular in FIG. 6, the two pivot arms 18*b* which are adjacent in the region of the associated cutting plane E1 have at least one slide spacing a from one another for the cutting wire 4*a*.

In order to illustrate both the initial position and also the notching position of the chamfering strips 15, FIG. 6 illustrates the upper chamfering strips 15 in the initial position and the lower chamfering strips 15 in the notching position.

The notching strips 8*e* or their drives are allocated stops A1, A2 which define the notching movement of the notching strips 8*e* in the notching position and e.g. also in the starting position. For the pivot arms 18*b*, e.g. strip-like stops A1, A2 can be disposed on the end regions, remote from the pivot joints 19, of the rear and/or front side of the modules 9, in particular on the inner side between the pivot arms 18*b* or, and e.g. also, on the outer side of the pivot arms 18*b*.

Figure 3:
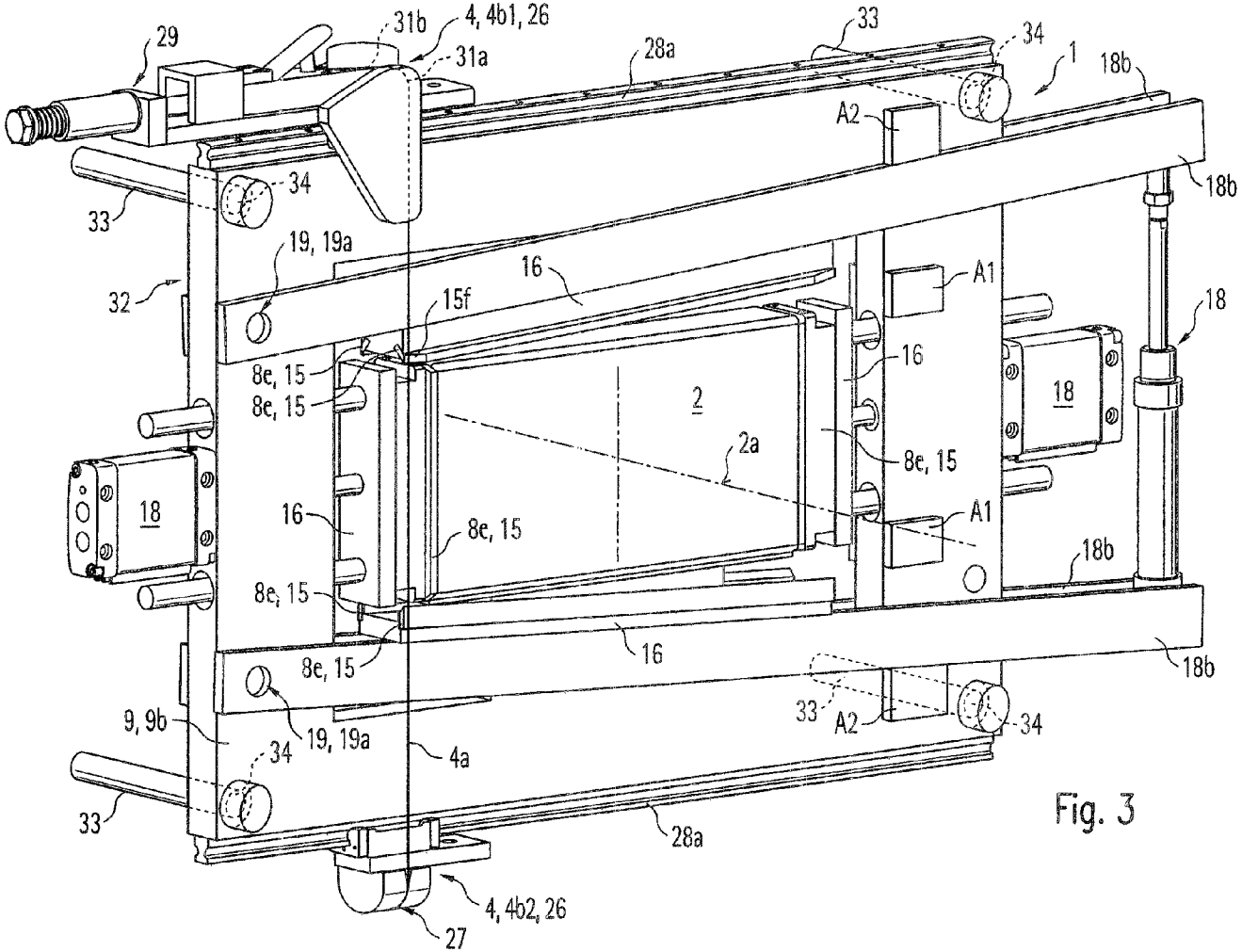
FIG. 3 shows a perspective illustration of the support module as shown in FIG. 1.

The lower chamfering strips 15 can be disposed e.g. vertically and can be disposed and fixed in the front or rear recesses 23 of the associated base part 16 which in each case support the associated chamfering strip 15 with a stepped surface 23*a*, against which the chamfering strip 15 lies and thus lies laterally and on the underside (FIGS. 2 and 3).

As shown in particular in FIG. 3 in the lower left or front corner regions, the two overlapped notching strips 8*e* or chamfering strips 15 can be adapted with their end-side end faces 15*d* to suit the contour or bevel of the notching surface 15*c* of the adjacent overlapping chamfering strip 15, wherein the overlapped chamfering strips 15 are formed on their end faces 15*d* facing towards the overlapping chamfering strips 15, e.g. in an inclined manner and lie against the chamfering surfaces 15*c* in the notching position. As a consequence, circumferential chamfers 14*a* are notched and the chamfering strips 15 are stabilised by means of a mutual abutment and support.

However, the chamfering strips 15 can also be connected in one part or in two parts to the associated pivot arm 18*b*, wherein an associated connection web extends preferably in the vertical projection of the associated pivot arm 18*b*, in order to take up as little space as possible in the longitudinal direction (bottom of FIG. 6).

In order to stabilise the attachment of the chamfering strips 15, two further embodiments as shown in FIG. 6 are also used. The upper and/or lower chamfering strips 15 are formed by means of strips which are disposed in an inclined manner and are flat per se and which together with their inner broadsides form the chamfering surfaces 15*c* and whose mutually remote outer sides form the lateral surfaces 15*b*. These inclined chamfering strips 15 can be inserted and fixed in correspondingly inclined grooves 22 in the associated base parts 16.

As shown in FIG. 6, the lower chamfering strips 15 are likewise disposed in an inclined manner in the above-described sense, wherein they are attached, however, by means of vertical webs 15*e* to the associated lower pivot arms 19*b*.

Located between the lower chamfering strips 15 are e.g. plate-like support parts 30, whose topsides are located at the height of the topside of the conveying device 1*a* provided for the strand 3 and which are supported on the lower region of the associated support module 9, 9*b*, 9*c*, 9*d*, e.g. directly on the lower frame portion of the frame-like support module 9, 9*b*, 9*c*, 9*d*.

In order to hold the chamfering strips 15 which have a longitudinal spacing a from each other, at least two support modules 9 are required which likewise have at least the spacing a from each other for the cutting wire 4*a* and in the region of their mutually facing sides support the chamfering strips 15 on the four peripheral sides.

In order simultaneously to provide notches on all four sides and to cut the strand 3 at at least one mutual spacing c which corresponds to the desired length L1 of the longitudinal portions 3*a*, it is advantageous to arrange three or several support modules 9, of which the initial module 9*b* supports the rear-side chamfering strips 15 of the first chamfering strip arrangement, the central module 9*c* supports in the region of its rear side the front-side chamfering strips 15 of the first chamfering strip arrangement and supports in the region of its front side the rear-side chamfering strips 15 of the second chamfering strip arrangement and the third support module or end module 9*d* supports the front-side chamfering strips 15 of the second chamfering strip arrangement. In the case of the exemplified embodiment, five support modules 9 are disposed lying one behind the other, wherein four notches 5*a* can be provided and four longitudinal portions 3*a* can be separated essentially at the same time.

The chamfering strips 15, which are associated with the central support modules 9*c*, namely the front-side chamfering strips 15 of the first chamfering strip arrangement and the rear-side chamfering strips 15 of the second chamfering strip arrangement are preferably attached in each case to the associated base part 16 which is attached e.g. to the pivot levers 18*b* of the associated central module 9*d* preferably on the underside.

Located between the base parts 16 and the support modules 9, 9*b*, 9*c*, 9*d* are vertically or horizontally extending free spaces 20 which permit movement of the chamfering strips 15 externally beyond the initial position for larger passage cross-sections.

In both cases where only one module 9 is provided with one cutting device 4 disposed and held thereon, and also where several support modules 9 are provided with cutting devices 4 disposed and held thereon, each cutting device 4 comprises at least two cutting wire holders 4*b*1, 4*b*2 which are each guided in a displaceable manner by means of a holder guide 25 transversely with respect to the passage 2, horizontally in the present exemplified embodiment, and can be moved therein in a reciprocating manner in each case by means of a cutting drive 26, in particular both wire holders 24 can be displaced simultaneously and preferably uniformly. Two holder guides 25 can be disposed in the upper and lower region of the associated support module 9, e.g. on the topside and bottom side thereof.

The present at least one cutting device 4 thus comprises an independent characteristic because it is formed with two cutting wires 4*a*1, 4*a*2 which are disposed on both sides of the associated support module 9 in two longitudinally spaced planes E, whose spacing c is substantially equal to the sum of the length L1 of the longitudinal portions 3*a* plus the cross-sectional dimension d of the cutting wire 4*a*. This spacing c is greater than the longitudinally directed dimension e of the support module 9, wherein this can be the outer dimension of the pivot arms 18*b*. The cutting wires 4*a*1, 4*a*2 can each be held by two front-side cutting wire holders 4*b*1, 4*b*2 and corresponding rear-side cutting wire holders.

The cutting wires 4*a*1, 4*a*2 are preferably formed by means of a common cutting wire 4*a* which is deflected in at least one associated boundary region of the support module 9, e.g. by means of a deflection device 27 having a deflection element which can be e.g. a round sliding element or a rotatably mounted roller and is disposed or rotatably mounted on or in the associated wire holder 24.

In the case of the present exemplified embodiment, the cutting device 4 and its arrangements on the associated support module 9 are each formed in an identical manner, so that only one cutting device 4 needs to be described.

If both cutting wires 4*a*1, 4*a*2 are formed by means of a common deflected cutting wire 4*a*, it is advantageous for the purpose of simplifying the construction to dispose and hold this cutting device 4 with both cutting wires 4*a*1, 4*a*2 on the associated support module 9. Therefore, in the presence of only one double-sided cutting device 4 only the central module 9*c* needs to be formed with this dual cutting device 4 and in the presence of more than three support modules 9 only each second central module 9*c* needs to be formed with the cutting device 4, as illustrated in FIG. 6.

The wire holders 24 can each be formed on a slide 24*a* which is acted upon by the cutting drive 26 and which is mounted in a displaceable manner in the holder guide 25. In the case of the exemplified embodiment, the holder guide 25 is formed by means of a respective guide rail 28*a* which is disposed on the bottom side and topside of the central module 9*c* and on which the associated slide 25*a* is displaceably guided with a matching guide element. The cutting drive 26 can be e.g. a cylinder piston drive or spindle drive. In the initial notching position illustrated in FIGS. 1, 2 and 4, the cutting wire 4*a* or the cutting wires 4*a*1, 4*a*2 is/are located in the boundary region of one side of the passage 2, e.g. in the region or on the outer side of the vertical notching strips 8*e* or base parts 16. From this position, the at least one cutting wire can be moved into the opposite-lying boundary region of the passage 2.

The spacing regions of the spacing a remote from the longitudinal axis 2*a* of the passage 2*b* are preferably formed to be outwardly divergent, in particular if in the initial notching position the cutting wire 4*a* is outwardly offset in relation to the notching strips. This improves threading of the cutting wire 4*a*. As shown in FIGS. 2 and 3, the chamfer strips 15 are provided with inclined or rounded insertion surfaces 15*f* at the ends.

The two wire holders 24 or the associated slides 24*a* or the guide elements thereof can be mechanically coupled together and/or can be moveable via an externally acting lever (not illustrated) in order to improve the movement drive.

The cutting device 4 is preferably allocated a clamping device 29 which is connected to one end of the cutting wire 4*a*; 4*a*1, 4*a*2 which is deflected or disposed on one side.

The clamping device 29 can be connected by means of a second deflection device 31 to a second, e.g. rotatably mounted, deflection element.

In this case, two deflection devices 27, 31*a*, 31*b* can be provided, of which the first 31*a* deflects the upwardly extending cutting wire horizontally and approximately in parallel with the passage 2 and the second 31*b* deflects the cutting wire horizontally outwards towards the clamping device 29. In the case of the present exemplified embodiment, an end-attachment device 33 or suspension device for the cutting wire is disposed e.g. in the region of the same side as the clamping device 29.

Alternatively, the cutting device 4 can be formed with a wire-unwinding device and wire-winding device and an associated drive, so that the cutting wire can be moved permanently or from time to time in its longitudinal direction.

In the case of a device 1 having only one support module 9 or several support modules 9 which are disposed one behind the other along the conveying passage 2, it is particularly advantageous to connect the support module(s) 9 by means of a receiving device 31 preferably in a releasable manner to form a module structural unit 32 which by means of the connection device 12 can be connected to the slide S and can thus be assembled thereon and then disassembled and exchanged, preferably by means of an assembly or disassembly movement which is directed transversely, in particular vertically, with respect to the passage 2.

The receiving device 31 comprises at least two receiving rods 33 which are disposed on mutually opposite sides and extend in parallel with the passage 2 and on which the support module(s) 9 is/are placed by means of matching receiving holes 34 disposed therein. In order to increase the stability of the module structural unit 32, preferably more than two receiving rods 33 are provided which extend through receiving holes 34 which are disposed preferably in the upper and lower region of the support module(s) 9. In the case of the present exemplified embodiments, four receiving rods 33 are provided which extend through four receiving holes 34 which are disposed in the corner regions of the support module(s) 9. The spacing f (FIG. 1) between the receiving rods 33 which extends transversely with respect to the passage 2 and transversely with respect to the cutting wires 4*a* or 4*a*1, 4*a*2 is greater than the spacing g between the cutting wires 4*a* in their two cutting end positions, so that the receiving rods 33 are located outside of the cutting region or passage 2 and do not obstruct same.

The support modules 9 can be held at a longitudinal spacing from one another by means of spacers 37*a*, e.g. spacer rings, which are disposed on the connection rods 33.

The module structural unit 32 can be preassembled with an optional number of support modules 9, so that a desired prefabricated receiving device 31 can be assembled quickly. The intended, handling-friendly and rapid disassembly and/or assembly can be achieved by means of a connection device 12 in the form of a quick-action connection, in particular in the form of a plug connection 13.

In the case of the present exemplified embodiments having several support modules 9 which are disposed one behind the other, two connection devices 12 disposed one behind the other are provided in each case on both sides of the passage, in order to increase the stability of the attachment.

The connection devices 12 are formed in a laterally reversed manner in relation to a vertical longitudinal central plane E2 of the passage 2 or of the device 1.

The connection parts of the connection device 12 which are associated with the slide S are designated by the reference 12*a* and the connection parts allocated to the module structural unit 32 are designated by the reference 12*b*. Within the scope of the invention, the latter connection parts 12*b* can also be disposed on the support module(s) 9.

The plug connection 13 present in the exemplified embodiments is formed in each case by a plug socket or plug recess 13*a* in one connection part and by a plug pin 13*b* in the other connection part. In the case of the exemplified embodiments, the plug recess 13*a* is disposed in the slide-side connection parts 12*a* and is preferably open at the top, wherein the module-side connection parts 12*b* are formed by the connection rods 33, e.g. by the end regions of the connection rods 33 which are received in a fitting manner in the plug recesses 13*a*. In order to facilitate insertion of the plug pins 13*b*, the plug recesses 13*a* comprise at their openings divergent insertion surfaces 13*d* which can be formed e.g. in an inclined or rounded manner.

The receiving rods 33 each comprise a first shoulder surface 35, against which the or an outermost support module 9 lies and is thereby positioned in a longitudinal direction. In the opposite longitudinal direction, the support module(s) 9 is/are positioned by means of a second shoulder surface 36 which is preferably formed by means of the associated end surface of a screw nut 37, with which the support module(s) 9 can be clamped against the first shoulder surface 35. Disposed on the receiving rods 33 is a corresponding external thread, onto which the screw nuts 37 are screwed.

The longitudinally directed screwing region on the receiving rods 33 is sufficiently long to allow the desired number of support modules 9 to be clamped and attached by means of the screw nut 37 against the first shoulder surface 35.

The receiving rods 33 are positioned in the longitudinal direction. As a consequence, the first shoulder surfaces 35 form a reference stop 38 which ensures an always identical initial position of the first support module 9 in relation to the device 1. In the case of the present exemplified embodiment, the first shoulder surfaces 35 are each [lacuna] by means of a rod head 33*a* which in the exemplified embodiment is disposed on the rear end of the receiving rods 33. The screw nut 37 and the first shoulder surface 35 each form a releasable clamping device 37*b*.

In order to position the module structural unit 32 in a longitudinally directed manner, two transversely disposed positioning surfaces 39*a* on the slide-side connection parts 12*a* are used which e.g. are directed towards one another, and against which lie module-side positioning surfaces 39*b* corresponding therewith. This provides a construction which is both simple and cost-effective to produce, if the positioning surfaces 39*a* are formed by means of transversely disposed base surfaces of the plug recesses 13*a* and the positioning surfaces 39*b* corresponding therewith are formed by means of the end surfaces of the receiving rods 33.

In both cases where only two connection devices 12 are provided lying transversely opposite one another or four connection devices 12 are provided in accordance with the exemplified embodiment, the module structural unit 32 is positioned in all horizontal directions by means of a positioning device 39 formed in this manner. An undesired upwards movement can be prevented by the locking elements 13*c*, of which e.g. only two need to be present, preferably lying transversely or diametrically opposite one another.

The longitudinally directed spacing h between the positioning surfaces 39*a* is thus equal to the length L2 of the receiving rods 33.

The slide S can be moved backwards and forwards in the above-described sense in a longitudinal guide by means of a slide drive 42, wherein by means of a suitable movement control, the conveying speed of the strand 3 or of the associated conveying device 1*a* is maintained during the forwards movement, so that the notching and cutting procedures can be performed during the forwards movement of the support module(s) 9, which is known per se.

In the case of the exemplified embodiment there are disposed two longitudinal guides 43 for the slide S which are disposed on both sides of the passage 2 and which are each formed by means of a guide rod 44 which is dimensioned to a corresponding length and which is supported by means of end-side supports 45 indirectly or directly on the frame of the device 1 and on which the slide S is mounted so as to be longitudinally displaceable by means of guide bushes 46.

The slide drive 42 is likewise supported indirectly or directly on the frame of the device 1 and it acts upon the slide S in order to move it forwards and backwards in the above-described sense.

The slide S can be formed by means of a plate or a frame which extends approximately horizontally from one boundary region to the other boundary region of the passage 2.

Figure 5:
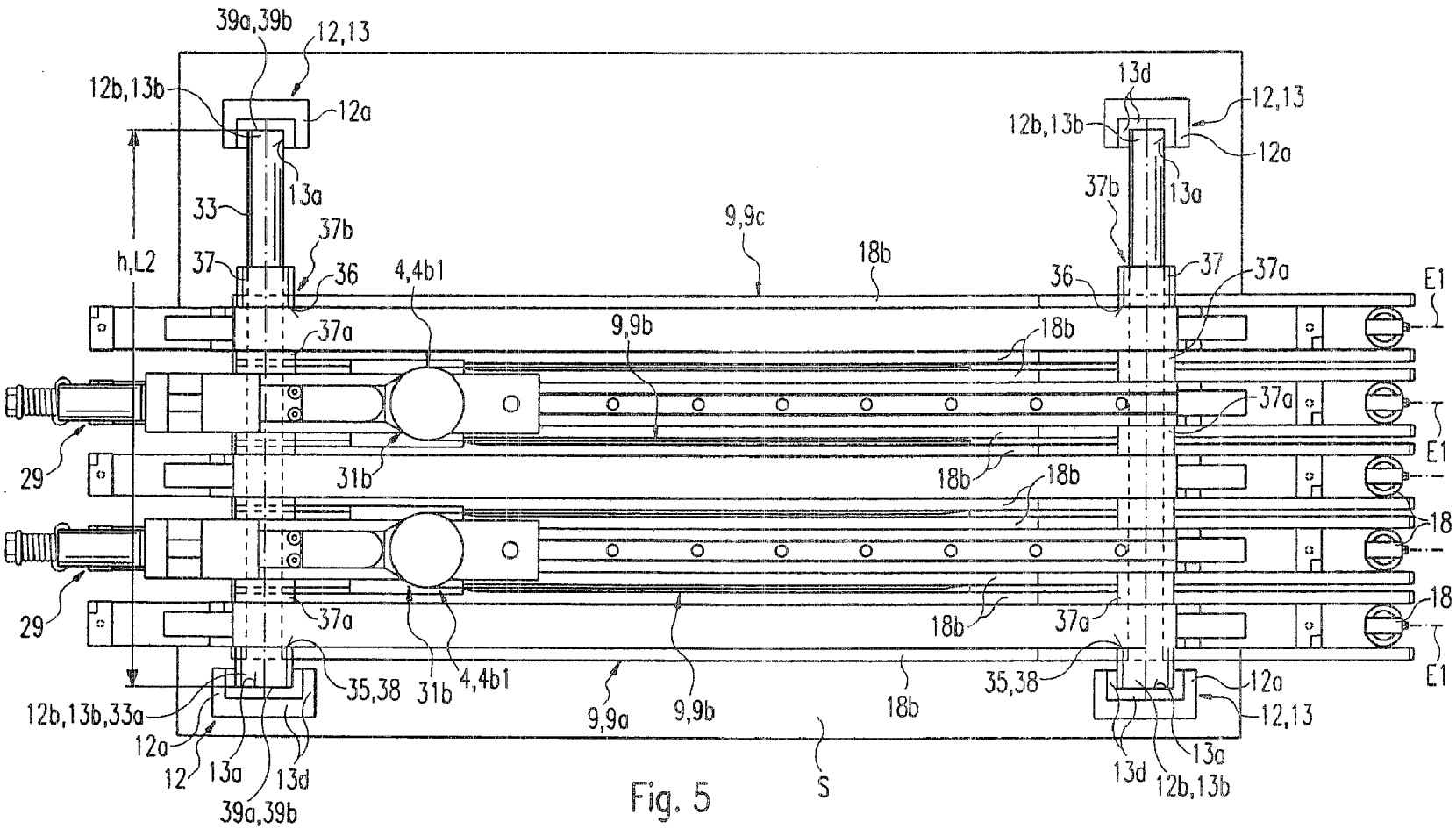
FIG. 5 shows a plan view of the support module arrangement as shown in FIG. 4.

As illustrated in particular in FIG. 5, the plug recesses 12*a* can be formed by means of vertical slots in the mutually facing sides of connection pieces which extend upwards indirectly or directly from the slide S.

Like the exemplified embodiments already described above, the exemplified embodiments shown in FIGS. 7 to 11 also comprise different configurations which produce advantageous constructions in their own right or also in combination with one or several of the other configurations. In these Figures, like or comparable parts are also designated by like reference numerals.

As shown in FIGS. 7 to 11, the device 1 comprises a modified notching device 5 which is arranged to notch or chamfer the strand 3*a* only on both sides and on the topside. This notching device 5 does not include the lower notching tool 8*d* or the lower notching strip 8*e* or the lower chamfering strips 15 which belong to a pair. The two lateral and topside notching tools 8*a*, 8*b*, 8*c* or notching strips 8*e* or chamfering strips 15 can be formed in accordance with the above-described exemplified embodiments or can also be formed differently.

Figure 7:
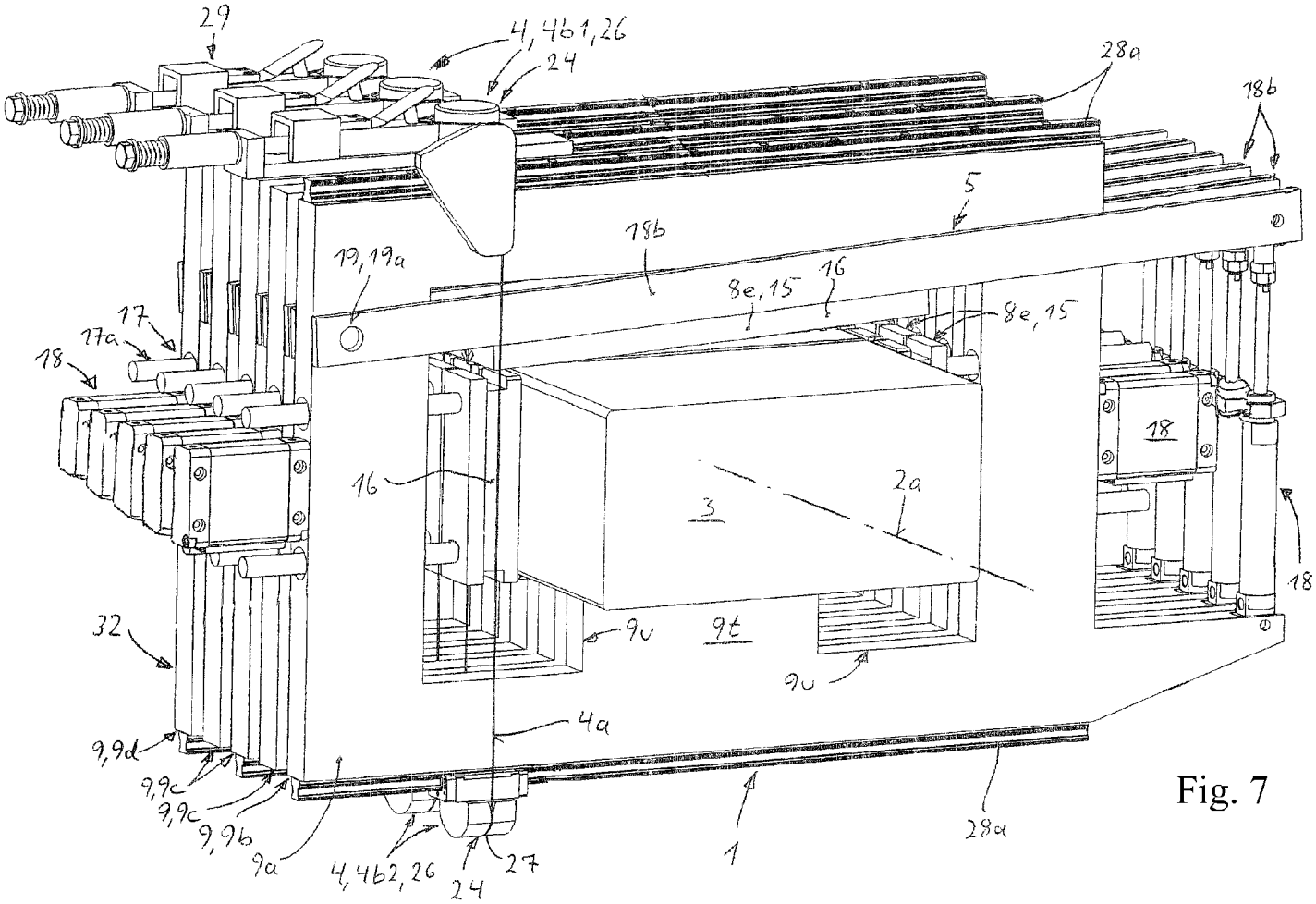
FIG. 7 shows a perspective illustration of a modified embodiment of several support modules which are disposed one behind the other in the longitudinal direction of the conveying passage and have notching devices and cutting devices for transversely directed notching and cutting of the strand.

FIG. 7 illustrates one or several, e.g. five, support modules 9 which are disposed one behind the other and form a module structural unit 32 and which differ from the above-described exemplified embodiments by virtue of the fact that no lower notching tool 8*d* or notching strip 8*e* or chamfering strips 15 are provided. In each case a notching tool 8*a*, 8*b*, 8*c* or notching strip 8*e* or chamfering strip 15 is provided merely on both sides or on the topside. In order to bear or support the strand 3, each support module 9 or each frame 9*a* comprises a support base 9*t*, whose planar topside lies in the conveyance plane and slidingly supports the strand 3. The transversely directed width i of the support base(s) 9*t* is slightly smaller in dimension than the horizontal width j of the strand 3, wherein on both sides of the support bases 9*t* hollowed recesses 9*u* are provided which form free spaces. In the case of this exemplified embodiment, the support bases 9*t* can also support plate-like support parts 30 on the topside. Gaps are provided between the frame 9*a* of several support modules 9 which are disposed one behind the other. For cutting purposes, the cutting wire 4*a* can be moved between the lateral and the upper chamfering strips 15 and in the above-described gap in the sense of unidirectional or bidirectional cutting.

During notching, i.e. in the case of the present exemplified embodiments during pressing of the chamfering strips 15 around the strand 3, a pressure is exerted thereon which can lead to a lateral displacement of the strand 3, which of course is undesirable. This applies in particular to lateral notching, since during topside-notching the strand 3 lies on the support base 9*b* or support parts 30 and is supported vertically.

Figure 8:
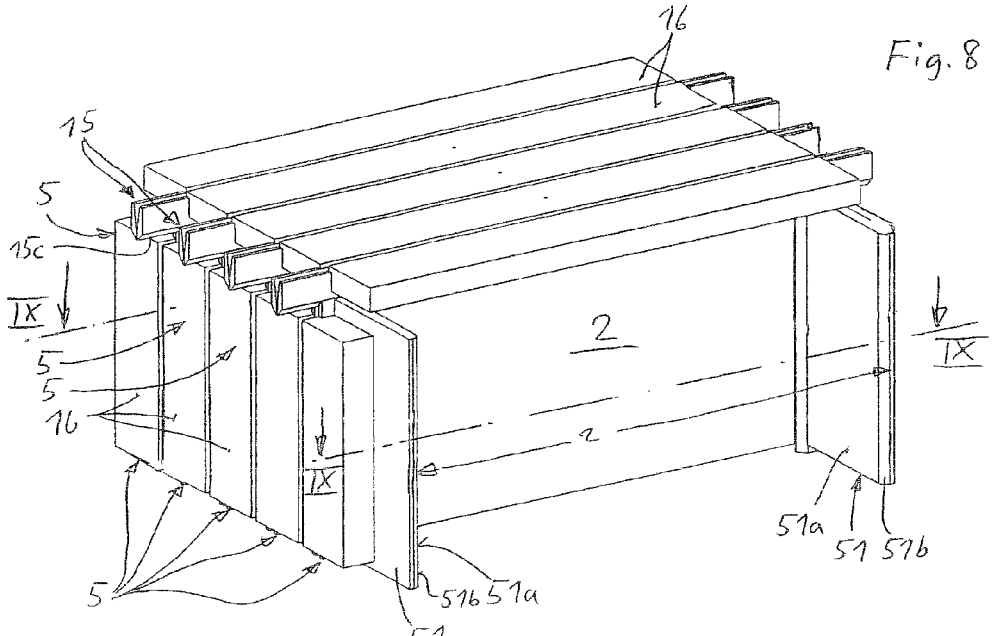
FIG. 8 shows a perspective illustration from the top and the rear of several groups which are disposed one behind the other and have in each case three chamfering strips which cooperate in terms of a notching device and are each disposed in the manner of a frame in the form of an inverted U.
Figure 9:
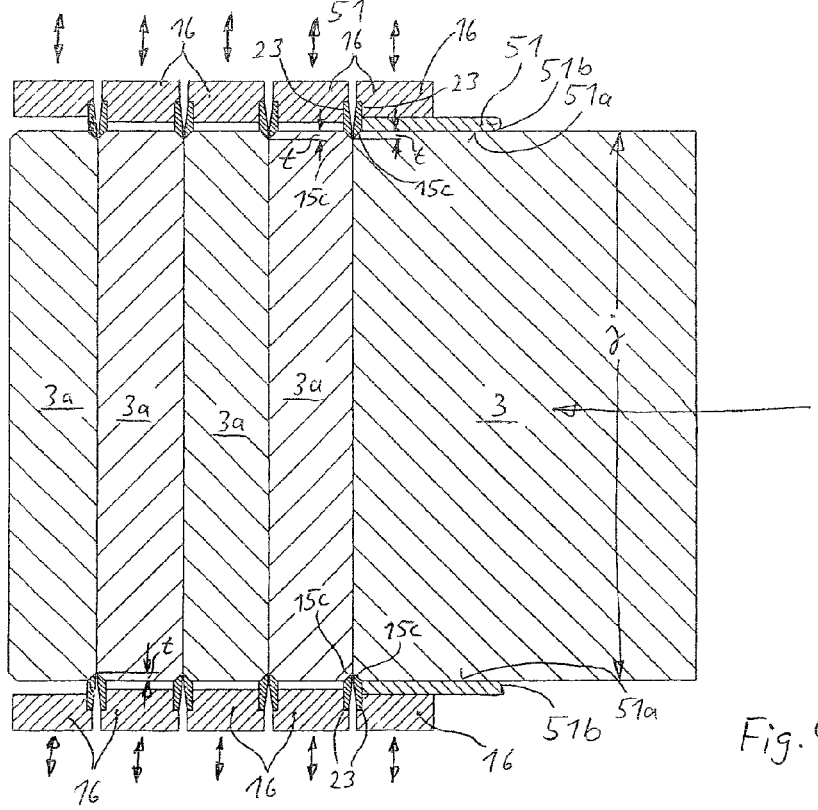
FIG. 9 shows the horizontal sectional view IX-IX in FIG. 8.

In order to support the strand 3 in its position, there is provided in the case of the exemplified embodiment as shown in FIGS. 8 and 9 on each side of the device 1 or of the passage 2 an support part 51 which is disposed edgewise, e.g. in the form of a support strip having a support surface 51*a* which extends in parallel with the longitudinal axis 2*b* of the passage 2 and faces towards the passage 2. Under consideration of movement clearance, the transverse spacing k between the mutually opposite-lying support surfaces 51*a* corresponds to the width j of the strand 3, so that it is supported laterally by means of the support strips 51 and cannot be displaced laterally during notching. In order to avoid any jams during conveyance of the strand 3 between the support strips 51, the rear vertical inner edges of the support strips 51 comprise rearwardly divergent insertion surfaces 51*b* which can be formed e.g. by means of inclined surfaces or rounded surfaces.

In the case of a device 1 which is arranged for a single width j of the strand 3, the support strips 51 can be disposed in a rigid or unmovable manner, e.g. on the associated or rearmost support module 9*b*, wherein preferably they protrude rearwardly therefrom.

In order to be able to adapt the support strips 51 to suit different widths j of strands 3, it is advantageous to mount the support strips 51 so as to be laterally displaceable and to form them so as to be moveable by means of a respective adjustment drive, so that they can be adapted to the respective width j, preferably symmetrical to the longitudinal central axis 2*b*.

In the case of the exemplified embodiment as shown in FIGS. 8 and 9, e.g. two support strips 51 are attached to mutually opposite-lying notching strips 8*e*, e.g. on the rearmost lateral notching strips 8*e*, so that they can be moved therewith to their support position by means of the respective notching strip drive and can then be moved back outwardly to their release position. In order to increase the size of the support surfaces 51*a*, the support strips 51 can protrude rearwardly beyond the notching strips 8*e* which are e.g. rearmost in FIG. 9.

If—as described above—the notching strips 5 consist of a base strip 16 and a chamfering strip 15 attached thereto, the support strips 51 as shown in FIG. 9 can be disposed on and attached to the inner sides of the base parts 16, wherein they extend forwards as far as the chamfering strips 15, wherein the notching webs of the chamfering strips 15 protrude beyond the support surfaces 51*a* of the support strips 51 inwardly by the depth t of the notches 5*a*. The inclined notching surfaces 15*c* of the chamfering strips 15 run out in a divergent or inclined manner to the support surfaces 51*a*.

In the case of this embodiment, the support strips 51 together with the associated notching strips 8*a* are moved simultaneously with the notching strips 8*e* between their support positions lying against the strand 3 and their release positions spaced outwardly apart therefrom and are also moved simultaneously and in opposite directions on both sides, wherein they fulfill their support function in their innermost support position.

Furthermore, in accordance with the exemplified embodiment as shown in FIG. 2, the lateral and the upper notching strips 8*e* or chamfering strips 15 can be formed in the upper region. As illustrated in FIG. 9, the chamfering strips 15 can be supported and attached in a positive-locking manner in the front-side and/or rear-side grooves 23 of the base parts 16 which support them.

Figure 10:
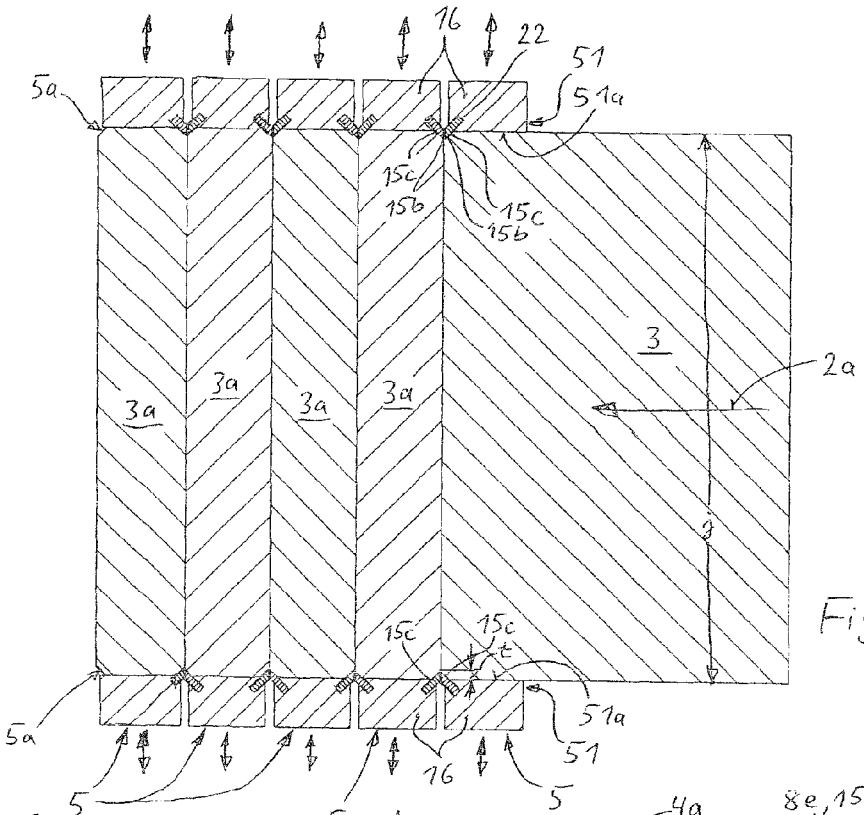
FIG. 10 shows a sectional illustration taken along line IX-IX in FIG. 8 of a modified embodiment of several groups which are disposed one behind the other and have lateral notching or chamfering strips.

In the case of the modified embodiment as shown in FIG. 10, the base parts 16 which support the chamfering strips 15 form the support strips 51 themselves, so that no particular support strips 51 are required. This is achieved by virtue of the fact that the base parts 16 form together with their inner surfaces, which extend in parallel with the longitudinal axis 2*a* of the passage 2, the support surfaces 51*a* which are planar in the present case. In the case of this embodiment, the chamfering strips 15 can be e.g. attached in this manner to the base parts 16 and in this case be received in inclined grooves 22, wherein they protrude beyond the inner surfaces or support surfaces 51*a* of the base parts 16 by the depth t of the notch 5*a*. The base parts 16 can be moved by the associated notching drives in such a manner that the support surfaces 51*a* are located in the notching position on the strand 3.

In order to achieve the intended stabilisation of the strand 3, not all of the notching strips 8*e* have to be formed with support parts 51 or support surfaces 51*a* but only some or a single one which also contributes to stabilisation.

Figure 11:
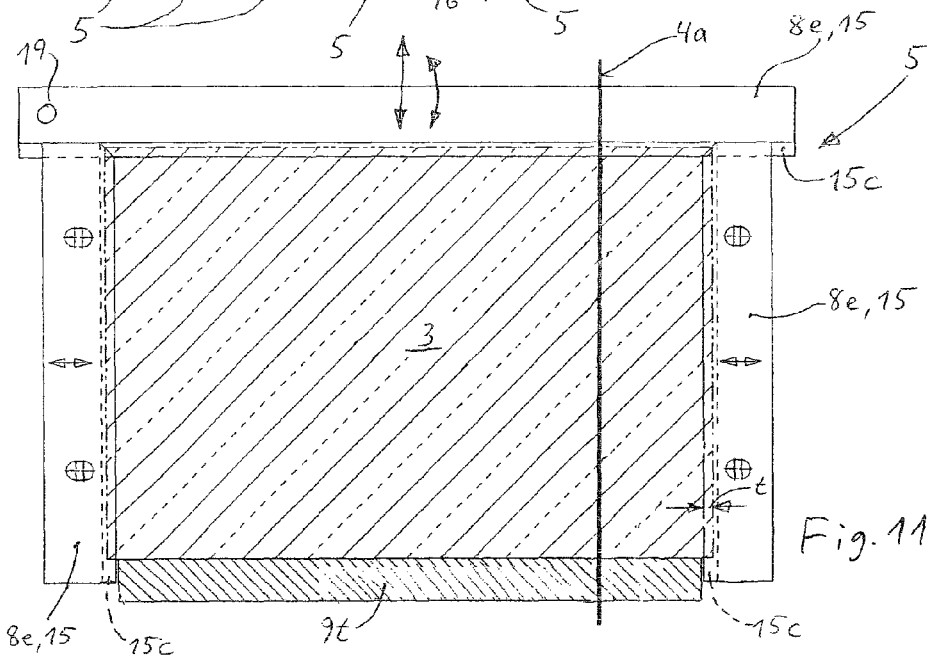
FIG. 11 shows a lower corner region or end region of a lateral notching or chamfering strip, as seen in the longitudinal direction of the conveying passage.

The lower corner region between the lateral chamfering strips 15 and the support base 9*b* can be formed in such a manner that the lower ends of the chamfering strips 15 protrude approximately downwardly beyond the support base 9*b* or the support plate 30. In the notching end positions, the chamfering webs of the chamfering strips 15 can comprise a movement clearance of one spacing from the lateral surfaces of the support base 9*t*, as illustrated in FIG. 11.

In the case of the embodiment as shown in FIG. 8, the upper chamfering strips 15 protrude outwardly beyond the lateral chamfering strips 15. This has the advantage that the cutting wire 4*a* which extends approximately vertically can remain in its lateral cutting stroke-end positions between the upper chamfering strips 15 and therefore does not need to be threaded during its horizontal further transverse movement.

Figure 12:
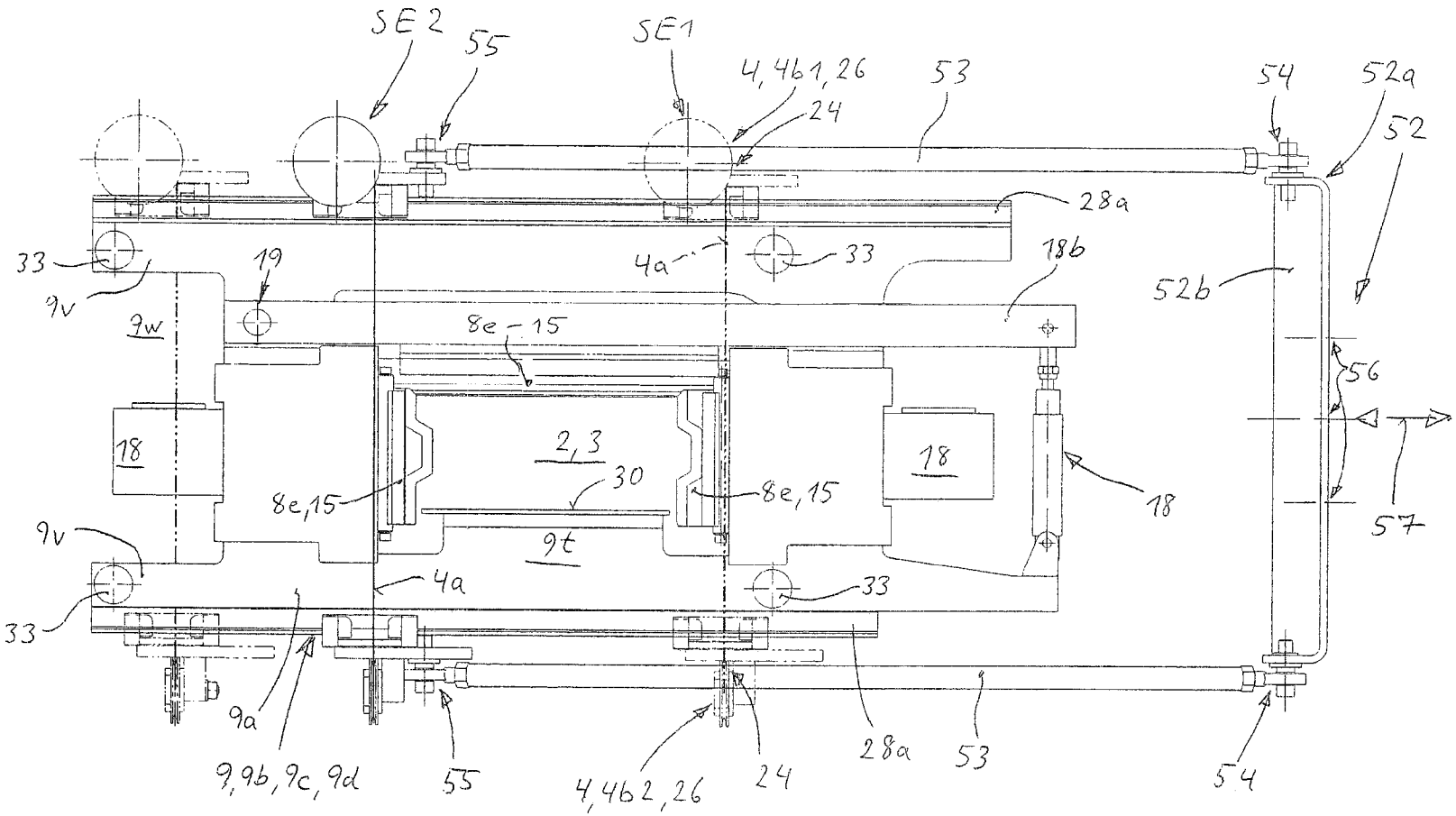
FIG. 12 shows a front view of a further-modified embodiment of a support module.

In the case of the exemplified embodiment as shown in FIG. 12, the support module(s) 9 or the frame 9*a* is/are lengthened in a lateral manner by means of an upper and lower lateral extension 9*d* preferably on the side on which the upper joint 19 is disposed, wherein between these extensions 9*v* there is provided a laterally open recess 9*w* which forms a free space between the extensions 9*v*. Moreover, the wire holders 24 or 24*a* can be displaced beyond the associated normal cutting stroke-end position in an extended holder guide 25 as far as the extensions 9*v*, so that the cutting wire 4*a* is located in the region of the recess 9*w* and thus in the associated free space.

In this position, the assembly, disassembly and servicing work on the cutting device 4 or on the cutting wire 4*a* can be performed in a manner facilitating ease of access and thus ease of handling.

Furthermore, the exemplified embodiment as shown in FIG. 11 also shows that the notching strips 8*e* or chamfering strips 15 can extend not only linearly but also can comprise a contour deviating from this, e.g. an inversely arranged U-shaped contour in order to be able to attach the chamfering surfaces 15*c* to clay bricks which on one side comprise a web and on the other side comprise a matching recess.

In contrast to the exemplified embodiment as shown in FIGS. 1, 3 and 4, in which the cutting drives 26, which drive the cutting wire holders 24 substantially in a uniform manner, are disposed on the respectively associated support module 9, in the case of the exemplified embodiment as shown in FIG. 12 only a part 52*a* of a cutting drive 52 which is referred to below is disposed on the support module 9. The remaining, not illustrated part of the cutting drive 52 can be supported e.g. on the slide S.

As shown in FIG. 12, a drive crossbar 52*b* is provided for the common drive of the wire holders 24 and in the case of the present exemplified embodiment it extends approximately vertically and its ends reach into the region of the wire holders 24. The drive crossbar 52*b* is connected by means of push rods and pull rods 53 to the wire holders 24 which extend approximately horizontally and are connected by means of joints 54, 55, e.g. having vertical articulation spindles, to the wire holders 24 and the drive crossbar 52*b*, preferably in a releasable manner. In the central region of the drive crossbar 52, a central connection element 56 or two connection elements 56, which are disposed eccentrically, is/are provided in order to connect a push and pull-drive element 57 which is illustrated in outlines and whose stroke is of such a magnitude that the wire holders 24 can be moved between the typical cutting stroke-end positions SE1, SE2 or—if present—beyond the relevant cutting stroke-end position into the region of the extensions 9*v* and into the outer-side end position or servicing position. The length of the push rods and pull rods 53 is formed to be a corresponding size.

The drive crossbar 52*b* and the push rods and pull rods 53 thus form a fork-like drive member in the form of a laterally tilted U, whose limbs which are formed by the push rods and pull rods 53 are disposed in the upper and lower end region of the support module 9 and engage over same e.g. in a U-shaped manner.

The fork-like drive member can also be formed by means of rigidly protruding push limbs and pull limbs which are connected in a releasable manner to the wire holders 24 e.g. by means of the joints 55.

The above-described cutting drive and/or the above-described support strips 51 can also be implemented in notching devices 5 which can be formed both in terms of 3-sided notching and also in terms of 4-sided notching.

Within the scope of the invention, the above-described embodiments can also be provided in other combinations and in other designs in each case.

The invention claimed is:

1. A device for separating a strand of plastic material, which can be moved along a conveying passage, into longitudinal portions, having at least one notching device for transversely notching the strand and a cutting device for transversely cutting the strand in the notches, wherein the notching device comprises notching tools which are mounted to be transversely movable by means of a tool drive between an initial notching position and a notching position, wherein the cutting device comprises at least one cutting element holder which is transversely movable with respect to the conveying passage by means of a cutting drive in a cutting guide, wherein the notching device is disposed with corresponding notching tools and tool drive on a support module which is mounted to be moveable forwards and backwards along the conveying passage, and wherein the cutting device is disposed with corresponding cutting element holder, cutting guide and cutting drive on the support module.

2. A device for separating a strand of plastic material, which can be moved along a conveying passage, into longitudinal portions, having at least one notching device for transversely notching the strand and a cutting device for transversely cutting the strand in the notches, wherein the notching device comprises notching tools which are transversely movable by means of a tool drive between an initial notching position and a notching position, wherein the notching device is disposed with corresponding notching tools and tool drive on a support module which is mounted to be moveable forwards and backwards along the conveying passage, wherein, on at least one side of the conveying passage, the associated notching tool is formed by means of a notching strip, and wherein the notching strip is mounted to be pivotable in a pivot joint transversely to the notching strip, which pivot joint is disposed on the support module in a manner outwardly offset in relation to the conveying passage.

3. A device for separating a strand of plastic material, which can be moved along a conveying passage, into longitudinal portions, having at least one notching device for transversely notching the strand and a cutting device for transversely cutting the strand in the notches, wherein the notching device comprises notching tools which are transversely movable by means of a tool drive between an initial notching position and a notching position, wherein the notching device is disposed with corresponding notching tools and tool drive on a support which is mounted to be moveable forwards and backwards along the conveying passage, wherein, on at least two mutually opposite sides of the conveying passage, the associated notching tool is formed by means of a notching strip which extends in the circumferential direction of the conveying passage, and wherein the device comprises on the sides, on which the notching strips are disposed, respectively, a support strip having a support surface for laterally supporting the strand, which support surface extends in parallel with the central axis of the conveying passage.

4. The device as claimed in any one of the preceding claims, wherein the cutting device comprises two cutting wire holders which are guided to be horizontally moveable from one side of the conveying passage to the other side in two holder guides which are disposed on mutually opposite sides of the conveying passage.

5. The device as claimed in claim 4, wherein the holder guides are disposed in mutually opposite-lying boundary regions of the support module and are disposed on the mutually opposite narrow sides of the support module.

6. The device, as claimed in claim 4, wherein the cutting device comprises two cutting wires which have a spacing from each other directed in the longitudinal direction of the conveying passage and are disposed on the rear side and the front side of the support module, respectively.

7. The device as claimed in claim 6, wherein the cutting wires are formed by means of a common cutting wire which is deflected in a boundary region of the support module by means of a first deflection device.

8. The device as claimed in claim 7, wherein the boundary region lying opposite the first deflection device is provided with a second deflection device which deflects the cutting wire transversely with respect to the first deflection device, horizontally and outwards.

9. Device as claimed in claim 4 wherein the device is allocated a clamping device for the cutting wire which clamping device is disposed in a preferably upper corner region of the support module in particular on the associated narrow side of the support module.

10. Device as claimed in claim 9, wherein the clamping device is disposed in the boundary region of the support module, in which a device for attaching a wire end is also disposed, in particular in the upper boundary region of the support module.

11. The device as claimed in claim 4, wherein a pivotable notching strip is an upper notching strip, or two mutually oppositely disposed and pivotably mounted notching strips are upper and lower notching strips.

12. Device as claimed in claim 4, wherein at least one notching strip protrudes from a pivot arm in the direction of the longitudinal axis of the passage.

13. Device as claimed in claim 4, wherein the notching strips which are allocated to a common transverse plane (E1) are formed in each case by means of two chamfering strips which extend in the circumferential direction of the passage and which have a spacing (a) from each other which is directed longitudinally of the passage, wherein a cutting wire of the cutting device can be moved between the chamfering strips transversely through the passage.

14. Device as claimed in claim 13, wherein two or several chamfering strip pairs which are disposed one behind the other in the longitudinal direction of the passage are provided with at least one cutting wire and can be moved preferably substantially simultaneously.

15. Device as claimed in claim 14, wherein three or several support modules are disposed one behind the other along the passage, of which the initial module supports the rear-side chamfering strips of the first chamfering strip pairs in the region of its front side, the next central module supports in the region of its rear side the front-side chamfering strips of the first chamfering strip pairs and supports in the region of its front side the rear-side chamfering strips of the second chamfering strip pairs, and the next module or end module supports in the region of its rear side the front-side chamfering strips of the second chamfering strip pairs.

16. Device as claimed in claim 4, wherein only every second central module supports a cutting device having two cutting wires.

17. The device as claimed in claim 4, wherein, at least in the upper region and/or in the lateral regions of the conveying passage, chamfering strips which are disposed on associated support modules are attached to a base part, on which the tool drive acts.

18. The device as claimed in claim 4, wherein support parts for supporting the strand are disposed between the lower notching strips or two or more chamfering strips.

19. Device as claimed in claim 4, wherein in the end positions of the cutting device the at least one cutting wire is located in the end region of the notching strips or chamfering strips extending transversely with respect to the cutting wire, or is outwardly offset in relation thereto.

20. Device as claimed in claim 4, wherein the spacing (a) between the chamfering strips, in particular in the spacing regions remote from the longitudinal axis of the passage, or in the end regions of the overlapping chamfering strips is widened in an outwardly divergent manner.

* * * * *